US007950763B2

(12) United States Patent
Hara

(10) Patent No.: US 7,950,763 B2
(45) **Date of Patent: *May 31, 2011**

(54) RECORDING METHOD

(75) Inventor: Keiji Hara, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 98 days.

This patent is subject to a terminal disclaimer.

(21) Appl. No.: 12/410,162

(22) Filed: Mar. 24, 2009

(65) Prior Publication Data

US 2009/0244145 A1 Oct. 1, 2009

(30) Foreign Application Priority Data

Mar. 25, 2008 (JP) ..... 2008-078860
Dec. 24, 2008 (JP) ..... 2008-328775

(51) Int. Cl.
*B41J 29/38* (2006.01)
*B41J 2/195* (2006.01)
*B41J 29/393* (2006.01)

(52) U.S. Cl. ..... 347/14; 347/7; 347/9; 347/19

(58) Field of Classification Search ..... 347/7, 9, 347/14, 19

See application file for complete search history.

(56) References Cited

U.S. PATENT DOCUMENTS 5,898,443 A * 4/1999 Yoshino et al. ..... 347/19
6,940,618 B2 * 9/2005 Kinas ..... 358/1.4
2009/0244158 A1 10/2009 Hara

FOREIGN PATENT DOCUMENTS

| | | |
|---|---|---|
| JP | 64-044756 | 2/1989 |
| JP | 07-009728 | 1/1995 |
| JP | 11-240146 | 9/1999 |
| JP | 2004-142269 | 5/2004 |
| JP | 2006-027220 | 2/2006 |
| JP | 2006-095768 | 4/2006 |
| JP | 2007-118373 | 5/2007 |
| JP | 2008-012712 | 1/2008 |

* cited by examiner

*Primary Examiner* — Matthew Luu
*Assistant Examiner* — Jannelle M Lebron
(74) *Attorney, Agent, or Firm* — Workman Nydegger

(57) ABSTRACT

A method for recording an image based on image data in a recording region of a recording medium being transported in a predetermined transportation direction includes forming a first reference mark in a recordable region, including the recording region, of the recording medium using a first colored liquid containing a colorant; supplying an uncolored liquid containing no colorant uniformly over the entire recordable region of the recording medium; forming a second reference mark in the recordable region of the recording medium using a second colored liquid containing a colorant; detecting the amount of misalignment between the first reference mark and the second reference mark; calculating the total amount, excluding the content of the colorant, of first colored liquid to be used to record the image based on the image data on the recording medium for each unit area of the recording region of the recording medium.

1 Claim, 8 Drawing Sheets

RECORDING METHOD

BACKGROUND

1. Technical Field

The present invention relates to methods for recording, for example, images on recording media using a liquid such as ink.

2. Related Art

One widely known recording apparatus for recording on recording media using a liquid is an ink-jet recording apparatus that ejects ink onto recording paper (hereinafter simply referred to as the "recording apparatus"). This type of recording apparatus includes a transportation mechanism that transports recording paper in a transportation direction and a recording head that ejects ink onto the recording paper transported into the apparatus by the transportation mechanism. When the recording apparatus receives image data from a host computer connected to the recording apparatus, the recording head ejects various inks onto the recording paper to record an image based on the image data in a recording region of the recording paper.

The recording paper used for recording can expand or contract under the effect of, for example, the atmosphere where the recording apparatus is installed (particularly, humidity) and the ejected inks. In addition, the recording paper can be transported by the transportation mechanism while remaining inclined with respect to the transportation direction. In such cases, the recording head can fail to eject the inks at appropriate positions on the recording paper. To solve this problem, the following two methods have been proposed.

In a first method, upon completion of recording on a first sheet of recording paper, the spacing between an end of a recording region of the recording paper subjected to recording and an end of the recording paper (i.e., the margin spacing) is measured, and the difference between that spacing and a predetermined spacing set as a recording condition in advance is calculated. Subsequently, recording on second and subsequent sheets of recording paper is performed such that the pattern of ink ejection onto the recording paper is corrected on the basis of the above difference. This allows appropriate recording on recording paper even if the recording paper expands or contracts or is transported while remaining inclined (see JP-A-2004-142269).

A second method is to use recording paper on which a predetermined mark is formed at a recording starting position in advance. When such recording paper is transported into the apparatus, the mark is detected by a mark detector (such as a sensor) and is used as a reference for ink ejection. As a result, an appropriate image is recorded at an appropriate position on the recording paper (see JP-A-7-9728).

A line-head recording apparatus has recently been under development that includes a plurality of (e.g., two) recording units having a length greater than or equal to that of recording paper in its width direction and arranged at intervals in the transportation direction. Of these recording units, an upstream recording unit positioned upstream in the transportation direction is configured so that it can eject some types of inks (e.g., cyan ink and magenta ink), whereas a downstream recording unit positioned downstream in the transportation direction is configured so that it can eject other types of inks (e.g., yellow ink and black ink). In this recording apparatus, the upstream recording unit ejects some types of inks onto the recording paper before the downstream recording unit appropriately ejects other types of inks onto the recording paper so that they overlap the positions where the inks ejected from the upstream recording unit have landed.

During the recording, the inks ejected from the upstream recording unit onto the recording paper may locally expand the sites where the inks have landed on the recording paper. This may cause the landing positions of the inks ejected from the downstream recording unit onto the same sheet of recording paper to deviate from target positions with respect to the landing positions of the inks ejected from the upstream recording unit. Such misalignment between the landing positions of the inks ejected from the upstream recording unit and the landing positions of the inks ejected from the downstream recording unit results in irregularities in the image recorded on the recording paper. There is therefore room for improvement in the quality of the image recorded on the recording paper.

SUMMARY

An advantage of some aspects of the invention is that it provides a recording method contributing to an improvement in the quality of an image recorded on a recording medium by supplying liquids onto the recording medium in two steps.

A method according to an aspect of the invention for recording an image based on image data in a recording region of a recording medium being transported in a predetermined transportation direction includes forming a first reference mark in a recordable region, including the recording region, of the recording medium using a first colored liquid containing a colorant; supplying an uncolored liquid containing no colorant uniformly over the entire recordable region of the recording medium; forming a second reference mark in the recordable region of the recording medium using a second colored liquid containing a colorant; detecting the amount of misalignment between the first reference mark and the second reference mark; calculating the total amount, excluding the content of the colorant, of first colored liquid to be used to record the image based on the image data on the recording medium for each unit area of the recording region of the recording medium; calculating a difference between the calculated amount of first colored liquid and a predetermined amount of water for each unit area as the amount of uncolored liquid to be supplied for each unit area; supplying the calculated amount of first colored liquid and the calculated amount of uncolored liquid onto the recording region of the recording medium; and supplying the second colored liquid to positions where at least one of the first colored liquid and the uncolored liquid has been supplied in the recording region of the recording medium such that the detected amount of misalignment is corrected.

In the above method, the first reference mark is formed in the recordable region of the recording medium using the first colored liquid before the uncolored liquid is supplied uniformly over the entire recordable region of the recording medium. The recording medium expands or contracts after the first colored liquid and the uncolored liquid are supplied. In this state, the second reference mark is formed in the recordable region of the recording medium using the second colored liquid. The expansion or contraction of the recording medium causes the positions of the reference marks to be misaligned even if the second reference mark is formed such that it would overlap the first reference mark if the recording medium did not expand or contract. In the above method, therefore, the amount of misalignment between the positions of the reference marks is detected. To record the image based on the image data on the recording medium, subsequently, the first colored liquid and the uncolored liquid are supplied onto the recording medium. When the second colored liquid is supplied to the positions of the recording medium where at least one of the first colored liquid and the uncolored liquid has been supplied, the second colored liquid is supplied such that the detected amount of misalignment is corrected. This contributes to an improvement in the quality of the image recorded on the recording medium by supplying the colored liquids onto the recording medium in two steps.

It is preferable that a recording system include a heating unit that heats the recording medium between recording units adjacent to each other in the transportation direction.

In this case, a liquid supplied from a recording unit disposed upstream in the transportation direction onto the recording medium is volatized to some extent by heating with the heating unit. This prevents the liquid supplied from the upstream recording unit onto the recording medium from spreading before another liquid is supplied from a downstream recording unit onto the recording medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

A recording method and recording system according to an embodiment of the invention will now be described with reference to FIGS. 1 to 8.

Figure 1A:
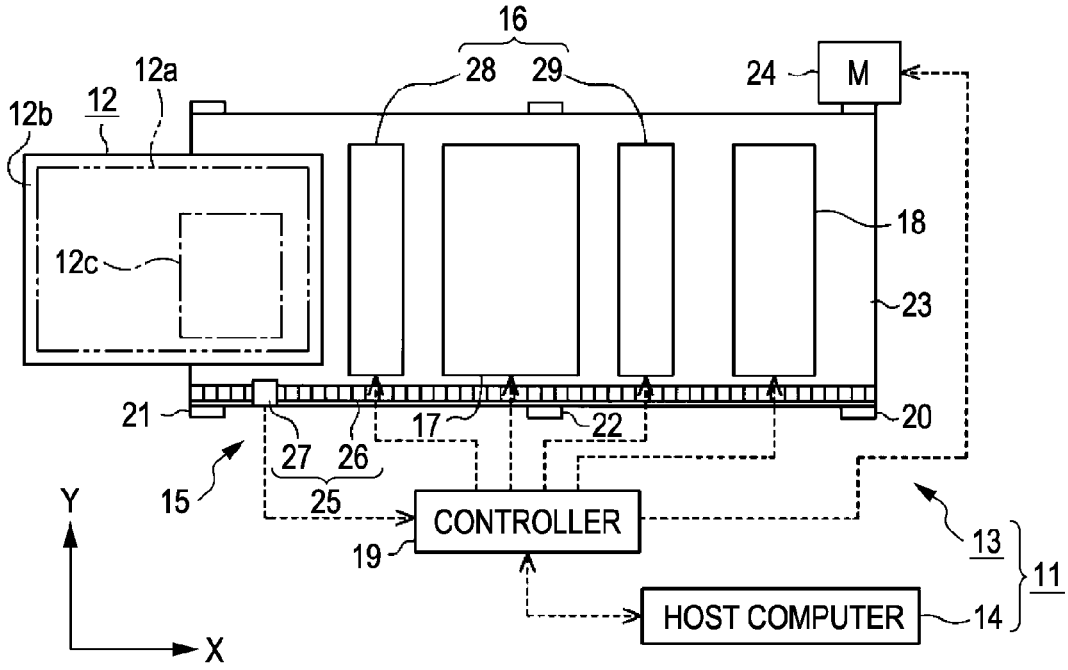
FIG. 1A is a schematic plan view of a recording system according to an embodiment of the invention.
Figure 1B:
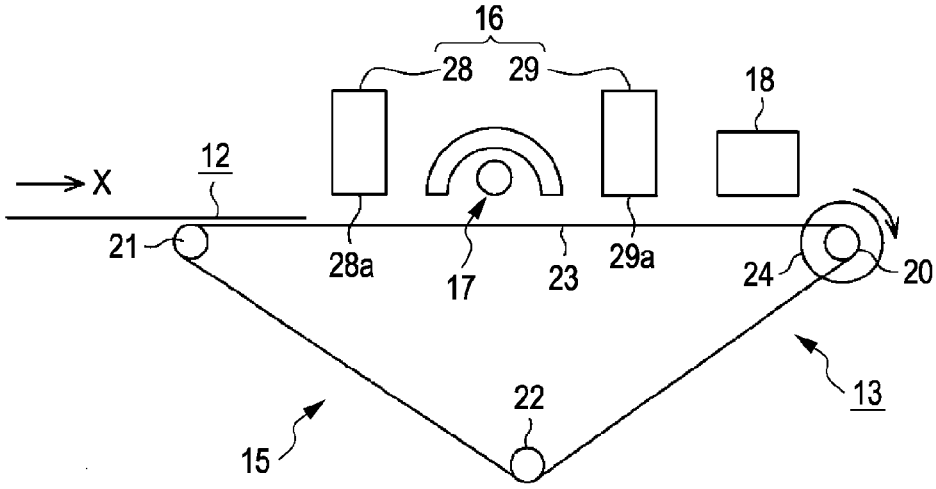
FIG. 1B is a schematic side view of an ink-jet recording apparatus.

Referring to FIGS. 1A and 1B, a recording system 11 according to this embodiment includes an ink-jet recording apparatus (hereinafter simply referred to as the "recording apparatus") 13 that ejects (supplies) water-soluble inks, serving as liquids, onto recording paper 12, serving as a recording medium, and a host computer 14 that can communicate various information (such as image data) with the recording apparatus 13. The recording apparatus 13 includes a transportation mechanism 15, serving as a transporting unit, that transports the recording paper 12 in a transportation direction X and a recording mechanism 16, serving as a recording section, that can supply the inks onto the recording paper 12 being transported by the transportation mechanism 15. The recording apparatus 13 also includes a heater 17, serving as a heating unit, that volatilizes water from the inks that have landed on the recording paper 12, a scanner 18 that can scan, for example, an image recorded on the recording paper 12, and a controller 19 that controls the overall recording apparatus 13.

The transportation mechanism 15 includes a drive roller 20 disposed downstream (to the right in FIG. 1) in the transportation direction X, a driven roller 21 disposed upstream (to the left in FIG. 1) in the transportation direction X, and a tension roller 22 disposed substantially midway between the drive roller 20 and the driven roller 21 and below the rollers 20 and 21 in FIG. 1B. The transportation mechanism 15 also includes an endless transportation belt 23 suspended around the rollers 20 to 22 and a transportation motor 24 that rotates the drive roller 20 in a predetermined rotational direction (in the arrow direction in FIG. 1B). The transportation belt 23 transports the recording paper 12 in the transportation direction X as the transportation motor 24 rotates the drive roller 20 in the predetermined rotational direction.

The transportation mechanism 15 further includes a linear encoder 25 (in this embodiment, a magnetic linear encoder) for measuring, for example, the driving speed of the transportation belt 23 and the position of the recording paper 12 on the transportation belt 23. The linear encoder 25 includes a magnetic linear scale 26 provided over the entire circumference of the transportation belt 23. The magnetic linear scale 26 has a strip-like magnetic recording layer forming a magnetic pattern of predetermined pitch in the circumferential direction of the magnetic linear scale 26. In addition, a magnetic sensor 27 for reproducing the magnetic pattern of the magnetic linear scale 26 is disposed near the magnetic linear scale 26 (on the viewer side of the magnetic linear scale 26 in FIG. 1A). The magnetic sensor 27 outputs a detected encoder signal to the controller 19.

The recording mechanism 16 includes a plurality of (in this embodiment, two) recording heads 28 and 29, serving as recording units, arranged at intervals in the transportation direction X. The length of the recording heads 28 and 29 in a width direction Y perpendicular to (crossing) the transportation direction X is greater than that of the recording paper 12 in the direction Y. Of these recording heads 28 and 29, the upstream recording head (most upstream recording unit) 28 disposed upstream in the transportation direction X is configured so that, of various inks (four types in this embodiment), serving as colored liquids containing colorants, it can eject a magenta ink and a cyan ink (first colored liquids) over an entire recordable region 12*a* (region surrounded by the two-dot chain line in FIG. 1A) of the recording paper 12. On the other hand, the downstream recording head (most downstream recording unit) 29 disposed downstream in the transportation direction X is configured so that it can eject a yellow ink and a black ink (second colored liquids) over the entire recordable region 12*a* of the recording paper 12. In addition, the recording heads 28 and 29 are configured so that they can eject a clear ink (colorless, transparent ink), serving as an uncolored liquid containing no colorant, over the entire recordable region 12*a* of the recording paper 12.

Figure 2:
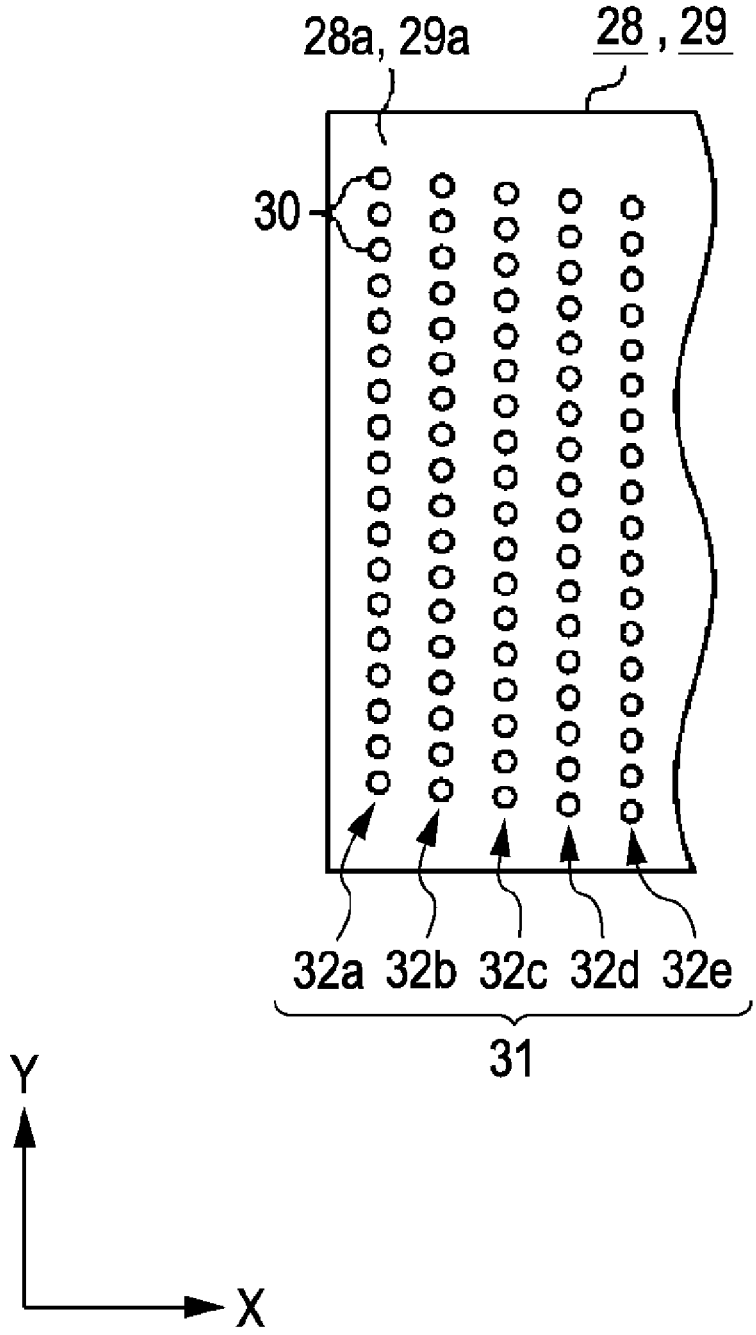
FIG. 2 is a schematic partial plan view of a nozzle surface.

Referring to FIG. 2, the surfaces of the recording heads 28 and 29 facing the recording paper 12 being transported by the transportation mechanism 15 are nozzle surfaces 28*a* and 29*a*, respectively, in which numerous nozzle orifices 30 are formed. In the nozzle surfaces 28*a* and 29*a*, nozzle groups corresponding to the types of inks (only a nozzle group 31 for the magenta ink is shown in FIG. 2) are arranged in the transportation direction X. In each of the nozzle surfaces 28*a* and 29*a*, the nozzle group for the clear ink is disposed downstream of the other nozzle groups (for the nozzle surface 28*a*, the nozzle group 31 for the magenta ink and the nozzle group for the cyan ink) in the transportation direction X.

The nozzle group 31 for the magenta ink includes a plurality of (in FIG. 2, five) nozzle columns 32*a*, 32*b*, 32*c*, 32*d*, and 32*e* arranged at regular intervals in the transportation direction X, each including a plurality of nozzle orifices 30 arranged at regular intervals in the width direction Y. The relationship between the nozzle columns 32*a* to 32*e* adjacent to each other in the transportation direction X is such that the topmost ones in FIG. 1A of the nozzle orifices 30 constituting the nozzle columns positioned upstream in the transportation direction X are slightly closer to the top of FIG. 1A than the topmost ones in FIG. 1A of the nozzle orifices 30 constituting the nozzle columns positioned downstream in the transportation direction X. That is, the nozzle orifices 30 constituting the nozzle group 31 for the magenta ink are arranged such that their positions differ in the width direction Y. For the nozzle groups for the other inks, no detailed description will be given because they are similar to the nozzle group 31 for the magenta ink.

As shown in FIGS. 1A and 1B, the heater 17 is disposed midway between the recording heads 28 and 29 in the transportation direction X. The heater 17 is driven so as to constantly apply a predetermined amount of heat to the recording paper 12 during recording on the recording paper 12.

Figure 3:
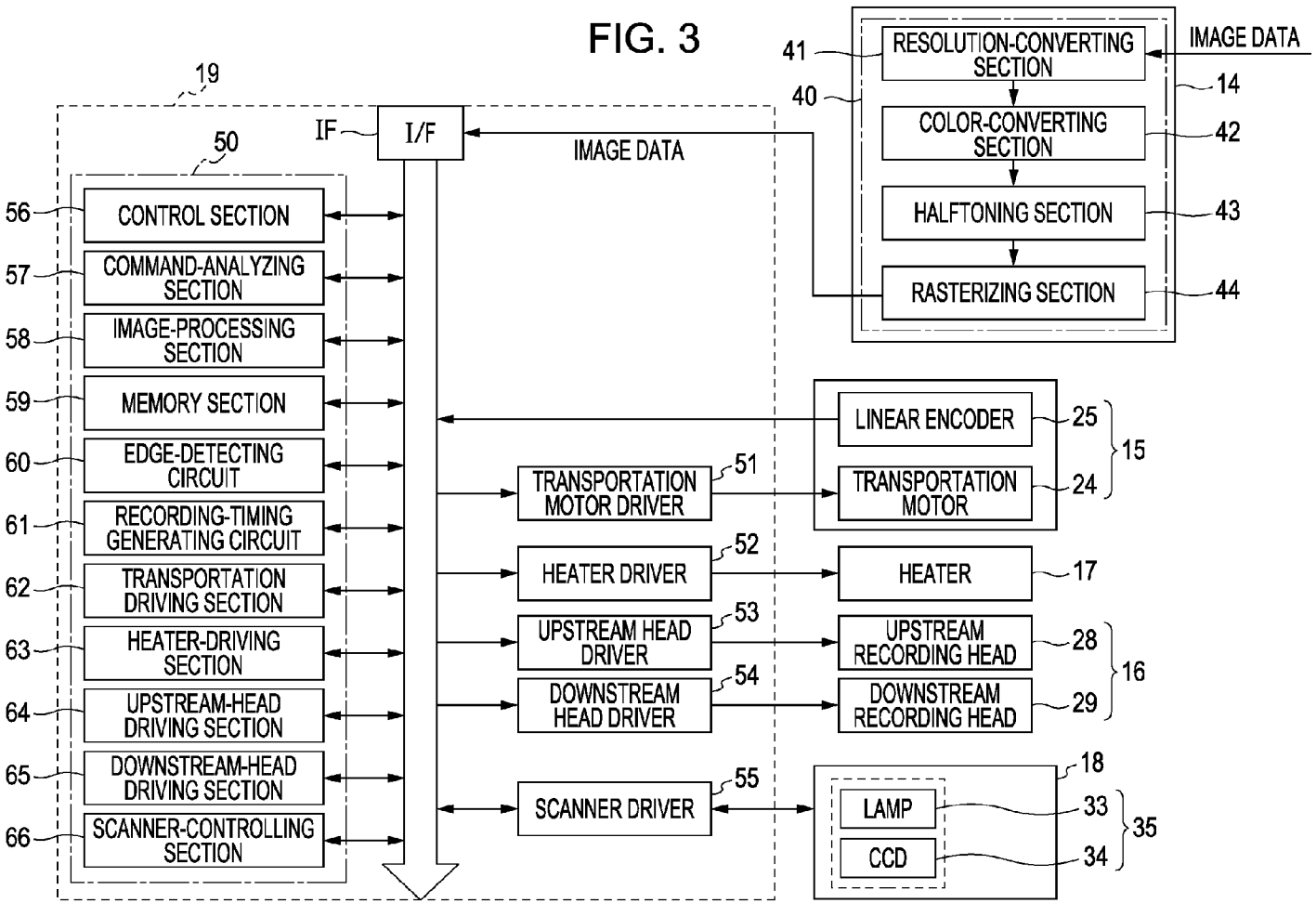
FIG. 3 is a block circuit diagram showing an electrical configuration in the embodiment of the invention.

The scanner 18 is disposed downstream of the downstream recording head 29 in the transportation direction X. Referring to FIG. 3, the scanner 18 includes a scanning unit 35 including a lamp 33 that illuminates the recording paper 12 and a charge-coupled device (CCD) 34 that acquires, for example, an image of the recording paper 12 as recording information. To acquire recording information from the recording paper 12 being transported by the transportation mechanism 15 by scanning action, the scanner 18 illuminates the recording paper 12 with light from the lamp 33 of the scanning unit 35 and detects the light reflected from the recording paper 12 through the CCD 34, thus acquiring an image of the recording paper 12 (reference marks, as described later) as recording information. The scanner 18 then transfers the recording information based on the acquired reference marks of the recording paper 12 to the controller 19.

Referring to FIG. 3, a printer driver 40 is constituted in the host computer 14 by a CPU (not shown) and programs of the host computer 14. This printer driver 40 includes a resolution-converting section 41, a color-converting section 42, a halftoning section 43, and a rasterizing section 44. The resolution-converting section 41 executes resolution conversion by which the resolution of image data of an image to be recorded on the recording paper 12 is converted into a recording resolution (also referred to as "print resolution") for the recording apparatus 13.

The color-converting section 42 receives RGB image data from the resolution-converting section 41 and executes color conversion. The color conversion is a process by which image data composed of gradation values of red (R) green (G), and blue (B) is converted into data composed of gradation values of cyan (C), magenta (M), yellow (Y), and black (K), which are used in the recording apparatus 13. This process is executed with reference to a color conversion table (lookup table; not shown). The color conversion table is conversion table data with which colors expressed by combinations of gradation values of R, G, and B are expressed by combinations of gradation values of C, M, Y, and K.

The halftoning section 43 receives the CMYK image data acquired by color conversion from the color-converting section 42 and executes halftoning (conversion of the number of gradations). In this embodiment, the image data after the color conversion is expressed as data with 256 gradations for each color. The recording apparatus 13, on the other hand, can only express four states by forming dots with the color inks, including "three types of dot areas (amounts of ink ejected)" and "no dot formed". That is, the recording apparatus 13 can locally express only four gradations. The halftoning section 43, therefore, converts RGB image data with 256 gradations into CMYK image data expressed by four gradations, that is, dot data with four gradations, which can be expressed in the recording apparatus 13.

The rasterizing section 44 receives dot data for ink dots of each color from the halftoning section 43 and executes interlacing. The interlacing is a process by which dot data with four gradations is sorted in the order in which the data is to be transferred to the recording apparatus 13 on the basis of the order in which dots are formed. The rasterizing section 44 then outputs the interlaced image data to the recording apparatus 13.

Next, the electrical configuration of the recording apparatus 13 according to this embodiment will be described with reference to FIGS. 3 to 5.

As shown in FIG. 3, the controller 19 of the recording apparatus 13 includes a control block 50 (region surrounded by the one-dot chain line in FIG. 3) constituted by, for example, a digital computer, a transportation motor driver 51 that drives the transportation motor 24, and a heater driver 52 that drives the heater 17. The controller 19 also includes an upstream head driver 53 that drives the upstream recording head 28, a downstream head driver 54 that drives the downstream recording head 29, and a scanner driver 55 that drives the scanner 18.

The control block 50 includes, for example, a CPU, a ROM, a RAM, an application-specific integrated circuit (ASIC), and a nonvolatile memory (such as an EEPROM). The control block 50 also includes, as functional elements realized by at least one of hardware and software, a control section 56, a command-analyzing section 57, an image-processing section 58, a memory section 59, an edge-detecting circuit 60, a recording-timing generating circuit 61, a transportation driving section 62, a heater-driving section 63, an upstream-head driving section 64, a downstream-head driving section 65, and a scanner-controlling section 66.

The control section 56 is constituted of the CPU and the ASIC. Upon reception of recording data from the host computer 14 via an interface IF, the control section 56 outputs a control command instructing the transportation mechanism 15 to transport the recording paper 12 to the transportation driving section 62. The control section 56 also outputs a control command instructing the heater 17 to heat the recording paper 12 (more specifically, to volatilize ink that has landed on the recording paper 12) to the heater-driving section 63.

The command-analyzing section 57 analyzes (interprets) a command contained in the recording data received from the host computer 14 to generate an intermediate code. The command-analyzing section 57 then stores the generated intermediate code in an intermediate buffer (not shown).

The image-processing section 58 converts the intermediate code stored in the intermediate buffer into bitmap data (gradation value data) in which recording dots (print dots) are represented by gradation values. The image-processing section 58 then expands the converted bitmap data in the memory section 59.

The memory section 59 has a memory region where the bitmap data converted by the image-processing section 58 is expanded. The bitmap data is read from the memory section 59 to the head driving sections 64 and 65 as needed.

The edge-detecting circuit 60 is a circuit for generating a recording timing signal PTS (see FIG. 4) for determining the timing of ink ejection from the nozzle orifices 30 of the recording heads 28 and 29. Referring to FIGS. 4 and 5, when the magnetic sensor 27 of the linear encoder 25 inputs an encoder signal to the edge-detecting circuit 60, the edge-detecting circuit 60 generates a pulse each time it detects the rising edge of the encoder signal, thus outputting a reference pulse signal RS with the same period as the encoder signal (encoder period) to the recording-timing generating circuit 61.

Figure 4:
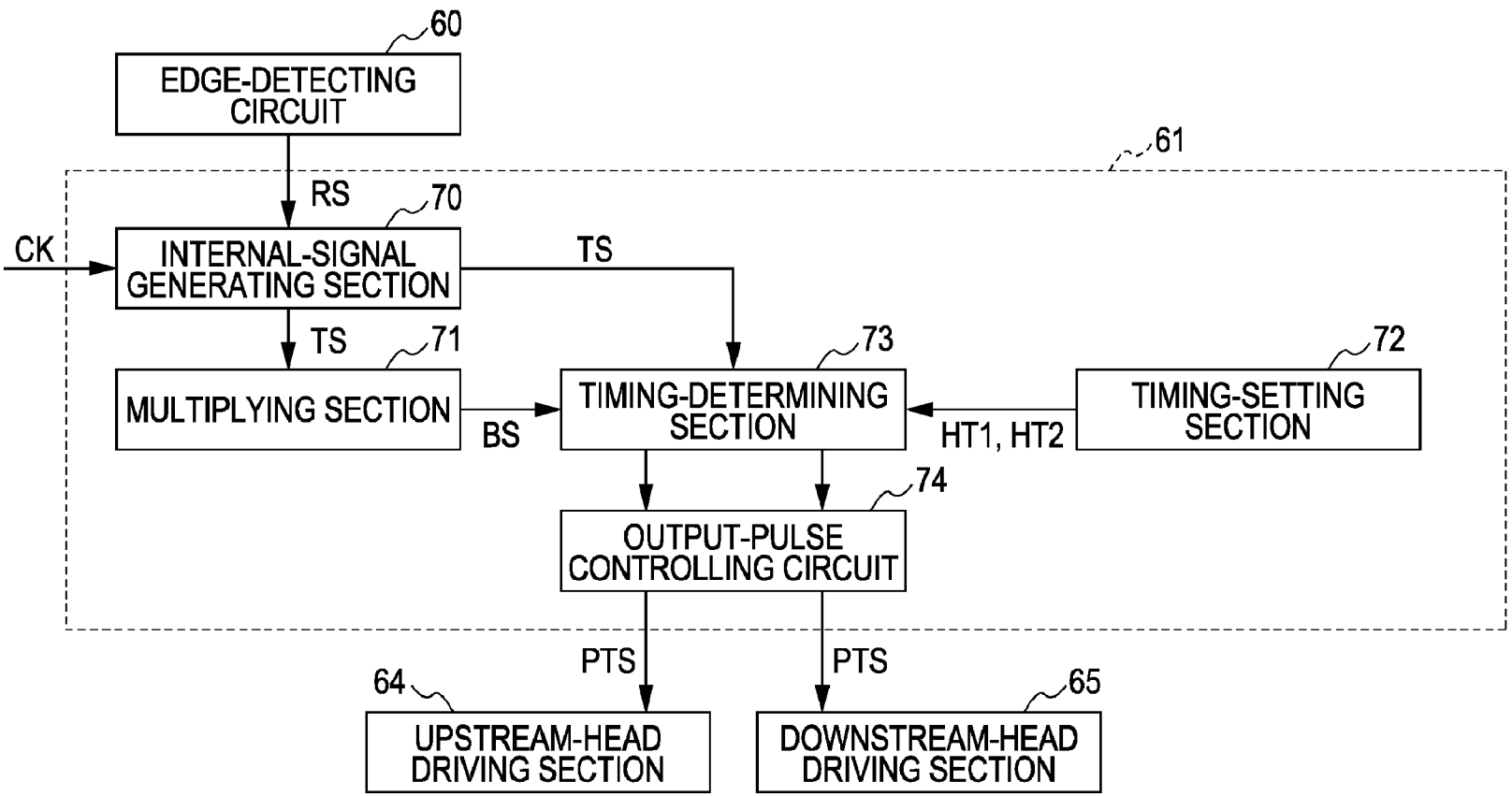
FIG. 4 is a block circuit diagram showing the configuration of a recording-timing generating circuit.
Figure 5:
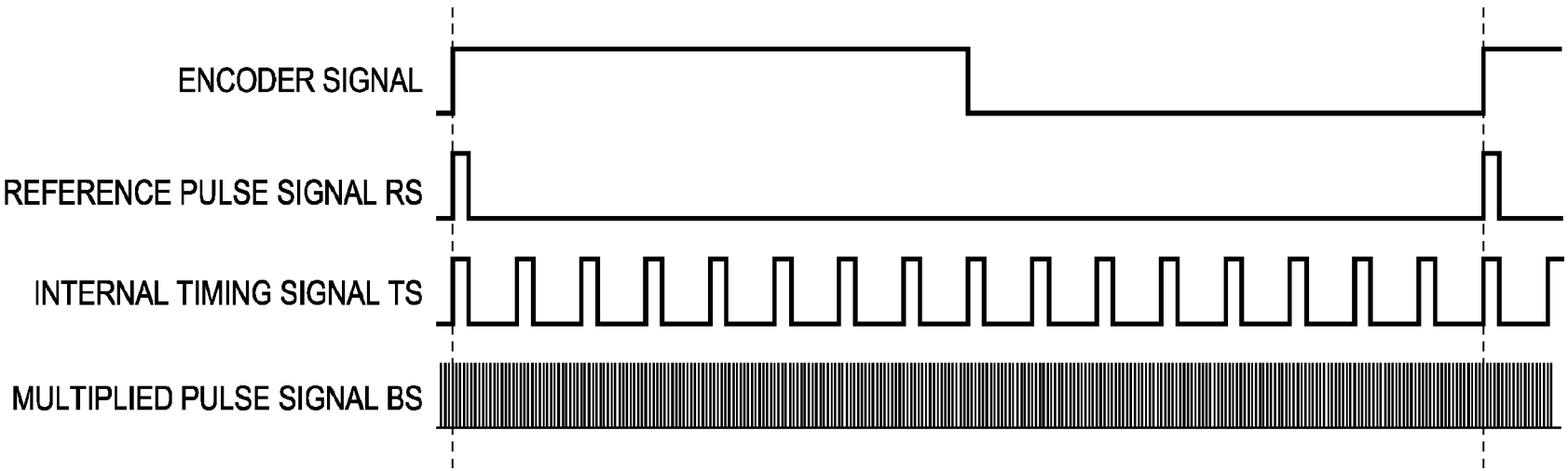
FIG. 5 is a timing chart showing an internal timing signal and a multiplied pulse signal.

The recording-timing generating circuit 61, as shown in FIGS. 4 and 5, includes an internal-signal generating section 70, a multiplying section 71, a timing-setting section 72, a timing-determining section 73, and an output-pulse controlling circuit 74. The internal-signal generating section 70 generates an internal timing signal TS, a pulse signal obtained by dividing one period of the reference pulse signal RS into 16 periods on the basis of the reference pulse signal RS input from the edge-detecting circuit 60 and a clock signal CK input from a clock circuit (not shown). The internal-signal generating section 70 then outputs the generated internal timing signal TS to the multiplying section 71 and the timing-determining section 73. The multiplying section 71 generates a multiplied pulse signal BS by further dividing (multiplying) one period of the input internal timing signal TS. The multiplying section 71 then outputs the generated multiplied pulse signal BS to the timing-determining section 73. The timing-setting section 72 acquires change times HT1 and HT2 by which the timing of ink ejection from the recording heads 28 and 29 is changed, on the basis of the results of a test procedure, as described later. The timing-setting section 72 then outputs the acquired change times HT1 and HT2 to the timing-determining section 73. The first change time HT1 for the upstream recording head 28 is set to "0 (zero)". The second change time HT2 for the downstream recording head 29 is set so that the ejection timing of the inks that are to land closer to the edges of the recording paper 12 is more significantly corrected.

The timing-determining section 73 determines the timing of ink ejection for each nozzle orifice 30 on the basis of the input internal timing signal TS, the multiplied pulse signal BS, and the change times HT1 and HT2. Specifically, the timing-determining section 73 determines the timing of ink ejection from each nozzle orifice 30 by correcting a set time based on the bitmap data expanded in the memory section 59 by the change times HT1 and HT2. After the set time corrected by the change times HT1 and HT2 elapses, the timing-determining section 73 outputs a control command to the output-pulse controlling circuit 74. The output-pulse controlling circuit 74, to which the control command has been input, generates a recording timing signal PTS and outputs it to the head-driving sections 64 and 65 so that the inks are ejected from the nozzle orifice 30 when the timing of ink ejection is reached.

The transportation driving section 62, as shown in FIG. 3, controls the transportation mechanism 15 via the transportation motor driver 51 on the basis of a control command from the control section 56. The transportation driving section 62 then controls, for example, the rotational speed of the transportation motor 24 in response to the encoder signal from the linear encoder 25.

When a control command for heating the recording paper 12 is input to the heater-driving section 63, it operates the heater 17 while the recording paper 12 is being transported by the transportation mechanism 15.

The upstream-head driving section 64 controls the pattern of ejection of the color inks from the nozzle orifices 30 of the upstream recording head 28 on the basis of the recording data (bitmap data) transferred from the control section 56 via the recording-timing generating circuit 61. The upstream-head driving section 64 also controls the upstream recording head 28 so that it ejects the clear ink over the entire recordable region 12*a* of the recording paper 12. Specifically, the upstream-head driving section 64 controls the upstream recording head 28 so that a larger amount of clear ink is ejected to positions where no color inks ejected from the upstream recording head 28 land in the recordable region 12*a* of the recording paper 12 than to positions where the color inks ejected from the upstream recording head 28 land. In addition, the upstream-head driving section 64 controls the upstream recording head 28 so that, of the positions where the color inks ejected from the upstream recording head 28 land in the recordable region 12*a* of the recording paper 12, a larger amount of clear ink is ejected to positions where the dots formed by the color inks are smaller than to positions where the dots formed by the color inks are larger.

The downstream-head driving section 65, on the other hand, controls the pattern of ejection of the color inks from the nozzle orifices 30 of the downstream recording head 29 on the basis of the recording data (bitmap data) transferred from the control section 56 via the recording-timing generating circuit 61.

The scanner-controlling section 66 controls the scanner 18 via the scanner driver 55 to scan, for example, an image recorded on the recording paper 12. The scanner-controlling section 66 then transfers recording information acquired when the scanner 18 scans the recording paper 12 to the control section 56.

Figure 6:
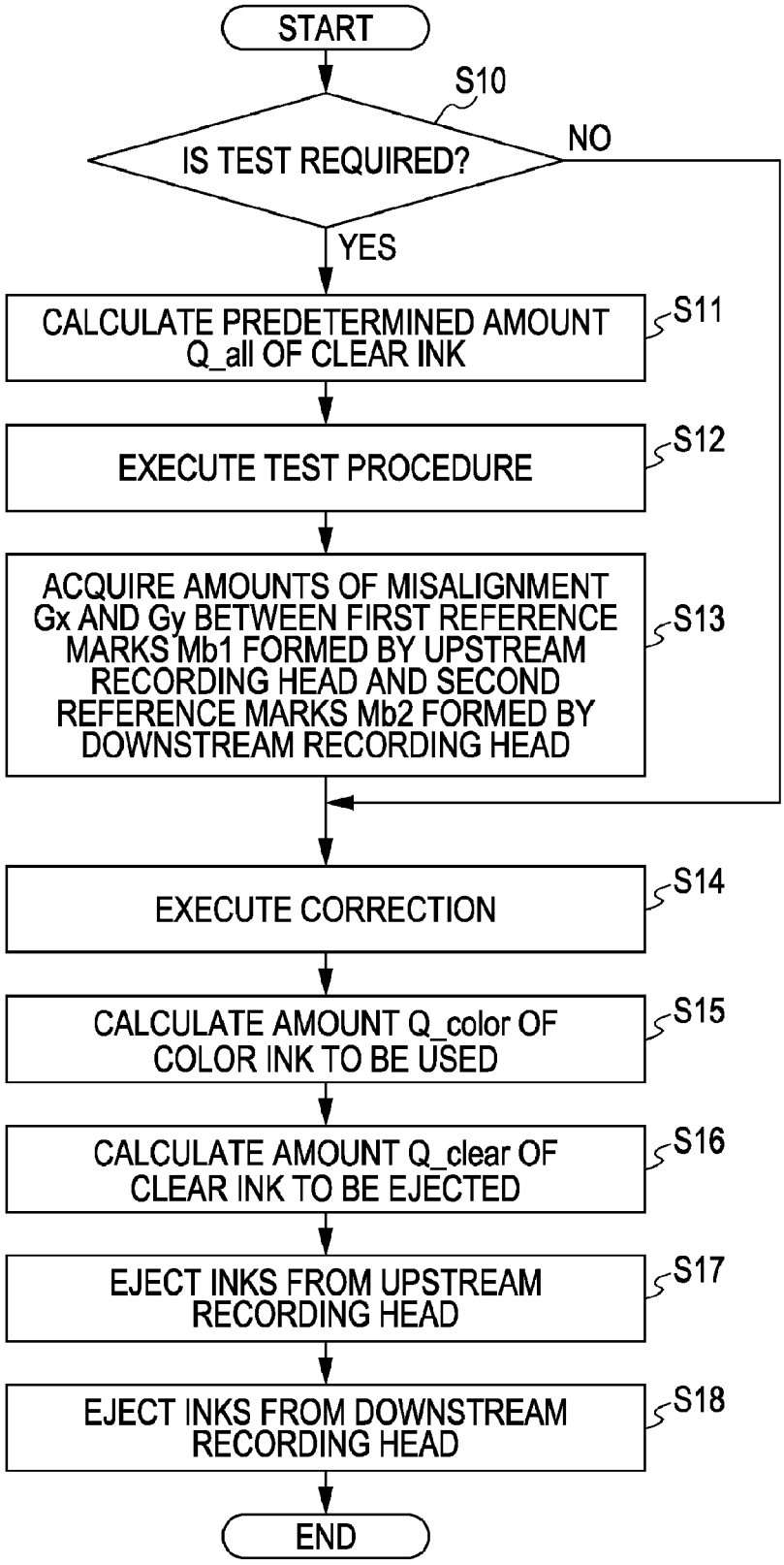
FIG. 6 is a flowchart of a recording routine in the embodiment of the invention.
Figure 7A:
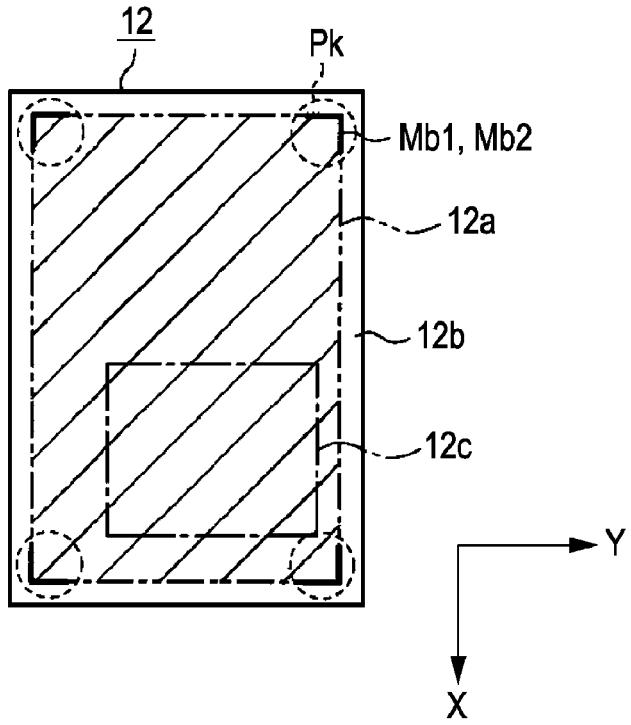
FIG. 7A is a schematic plan view of recording paper.
Figure 7B:
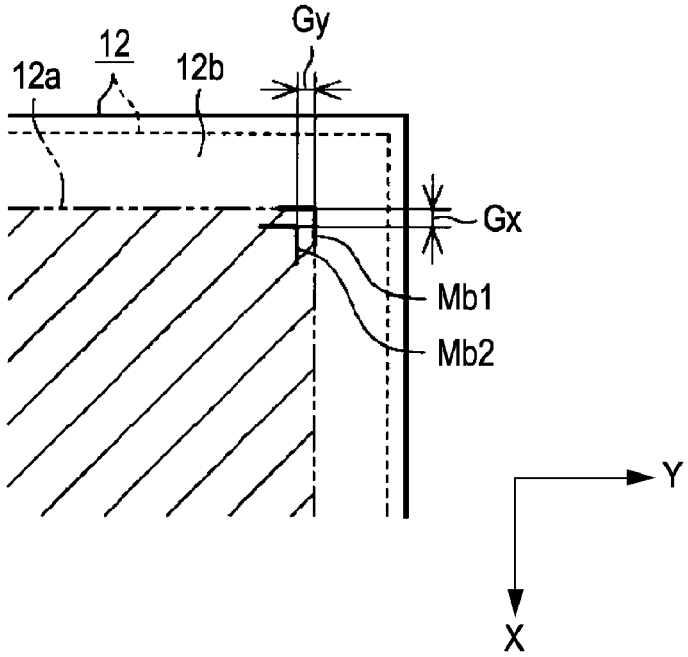
FIG. 7B is a partial enlarged view of FIG. 7A.

Next, of various control routines executed by the control section 56 in this embodiment, a recording routine executed to record an image on the recording paper 12 will be described with reference to the flowchart shown in FIG. 6 and the diagrams shown in FIGS. 7A and 7B.

The control section 56 executes the recording routine when receiving image data from the host computer 14. In the recording routine, the control section 56 determines whether or not there is a need for a test for acquiring the amount of misalignment between the landing positions of the inks ejected from the upstream recording head 28 onto the recording paper 12 and the landing positions of the inks ejected from the downstream recording head 29 onto the recording paper 12 (Step S10). Specifically, if the recording conditions are changed, including the size and type of recording paper 12 used for recording and the internal temperature and humidity of the recording apparatus 13, the recording paper 12 expands or contracts to varying degrees after the inks are ejected from the recording heads 28 and 29 onto the recording paper 12. In Step S10, therefore, the control section 56 determines whether or not the recording conditions have been changed since the last test. For example, if the size of the recording paper 12 is changed, the image data received from the host computer 14 contains information about the size of the recording paper 12. The control section 56 then determines whether or not the size of the recording paper 12 to be used this time is the same as that of the recording paper 12 used in the previous recording.

If the result of the determination in Step S10 is negative, the control section 56 determines that the recording conditions remain the same as those of the last test and shifts the process to Step S14, as described later. If the result of the determination in Step S10 is affirmative, as shown in FIG. 7A, the control section 56 calculates, as a predetermined amount Q_all, the amount of clear ink used if the clear ink is uniformly ejected over the entire recordable region 12*a* (region surrounded by the two-dot chain line in FIG. 7A) of the recording paper 12 used in image recording (that is, so that the amount of clear ink absorbed for each unit area is substantially the same in the recordable region 12*a*) (Step S11). The recordable region 12*a* is a region surrounded by a frame-shaped marginal region 12*b* formed along the edges of the recording paper 12 so that no ink adheres to the transportation belt 23, which transports the recording paper 12, that is, a region set for each type of recording paper 12 in advance. The predetermined amount Q_all is the total amount of ink ejected from the recording heads 28 and 29 in the case where the inks are ejected onto the recording paper 12 so that the content of water is maximized for each unit area of the recordable region 12*a* of the recording paper 12.

Subsequently, the control section 56 executes a test procedure on the recording paper 12 (Step S12). Specifically, the control section 56 outputs a control command for transporting the recording paper 12 to the transportation driving section 62, which rotates the transportation motor 24 via the transportation motor driver 51 in the above predetermined rotational direction. The transportation mechanism 15 then transports the recording paper 12 at constant speed in the transportation direction X. The control section 56 also outputs to the upstream-head driving section 64 a control command for forming first reference marks Mb1 serving as an acquisition reference for acquiring the amounts of misalignment Gx and Gy at measurement positions Pk set at the four corners of the recordable region 12*a* of the recording paper 12. When the recording-timing generating circuit 61 inputs the recording timing signal PTS to the upstream-head driving section 64, it causes the magenta ink to be ejected from the upstream recording head 28 via the upstream head driver 53. Subsequently, the control section 56 outputs to the upstream-head driving section 64 a control command for ejecting the predetermined amount Q_all, calculated in Step S11, of clear ink over the entire recordable region 12*a* of the recording paper 12. When the recording-timing generating circuit 61 inputs the recording timing signal PTS to the upstream-head driving section 64, it causes the clear ink to be ejected from the upstream recording head 28 via the upstream head driver 53. That is, the clear ink is ejected to the positions where the first reference marks Mb1 are formed in the recordable region 12*a* of the recording paper 12 in the X direction after the first reference marks Mb1 are formed.

In addition, the control section 56 separately outputs to the head-driving sections 64 and 65 a control command for forming second reference marks Mb2 serving as an acquisition reference for acquiring the amounts of misalignment Gx and Gy at the measurement positions Pk set at the four corners of the recordable region 12*a* of the recording paper 12. When the recording-timing generating circuit 61 inputs the recording timing signal PTS to the downstream-head driving section 65, it causes the black ink to be ejected from the downstream recording head 29 via the downstream head driver 54. The downstream-head driving section 65 then forms the second reference marks Mb2 on the recording paper 12 so that they would overlap the first reference marks Mb1 formed by the upstream recording head 28 if the recording paper 12 did not expand or contract after ink ejection from the upstream recording head 28 onto the recording paper 12. The second reference marks Mb2 are formed at positions where the clear ink has already landed in the recordable region 12*a* of the recording paper 12. Thus, Step S12 corresponds to an acquisition-preparing step in this embodiment. The reference marks Mb1 and Mb2 are marks composed of first straight-line portions extending in the transportation direction X and second straight-line portions extending in the width direction Y.

Subsequently, the control section 56 outputs a control command for scanning the reference marks Mb1 and Mb2 formed by the recording heads 28 and 29 at the measurement positions Pk of the recording paper 12 to the scanner-controlling section 66 (Step S13). The control section 56, as shown in FIG. 7B, calculates, for each measurement position Pk, the first amount of misalignment Gx in the transportation direction X and the second amount of misalignment Gy in the width direction Y between the first reference marks Mb1 formed by the upstream recording head 28 and the second reference marks Mb2 formed by the downstream recording head 29, on the basis of image information acquired by scanning with the scanner 18. The control section 56 then calculates the average of the first amounts of misalignment Gx and the average of the second amounts of misalignment Gy as the first amount of misalignment Gx and the second amount of misalignment Gy, respectively, in the recording paper 12. Thus, the control section 56 also functions as an acquiring unit in this embodiment. In addition, Step S13 corresponds to an acquiring step.

Subsequently, the control section 56 outputs the image data and a control command for correcting the timing of ink ejection to the image-processing section 58 and the recording-timing generating circuit 61, respectively, on the basis of the first amount of misalignment Gx and the second amount of misalignment Gy acquired in Step S13 (Step S14). Of the recording dots constituting the bitmap data expanded in the memory section 59, the image-processing section 58 shifts the recording dots to be formed by the inks ejected from the downstream recording head 29 by a distance equivalent to the second amount of misalignment Gy in the width direction Y.

Specifically, of the recording dots to be formed by the downstream recording head 29, the correction for the recording dots to be formed by the inks landing on the +Y direction side (to the right in FIG. 7A) with respect to the center of the recordable region 12*a* in the width direction Y is performed so that the landing positions of the inks are shifted in the +Y direction. On the other hand, the correction for the recording dots to be formed by the inks landing on the −Y direction side (to the left in FIG. 7A) with respect to the center of the recordable region 12*a* in the width direction Y is performed so that the landing positions of the inks are shifted in the −Y direction. In addition, the recording dots corresponding to the inks landing closer to the ends of the recording paper 12 in the width direction Y are subjected to a larger amount of shift (amount of correction).

In addition, the timing-setting section 72 of the recording-timing generating circuit 61 sets the second change time HT2 so that the timing of ink ejection from the downstream recording head 29 is changed by the time corresponding to the first amount of misalignment Gx with respect to the recording dots formed by the upstream recording head 28. Specifically, of the recording dots to be formed by the downstream recording head 29, the second change time HT2 for the recording dots to be formed by the inks landing on the +X direction side (on the lower side in FIG. 7A) with respect to the center of the recording paper 12 in the transportation direction X is set to a negative period of time so that the landing positions of the inks are shifted in the +X direction. On the other hand, the second change time HT2 for the recording dots to be formed by the inks landing on the −X direction side (on the upper side in FIG. 7A) with respect to the center of the recording paper 12 in the transportation direction X is set to a positive period of time so that the landing positions of the inks are shifted in the −X direction. In addition, the second change time HT2 for the inks landing closer to the ends of the recording paper 12 in the transportation direction X is set to a larger absolute value.

The control section 56 then calculates, for each unit area, the total amount Q_color, excluding the colorant content, of color ink (magenta and cyan inks) to be used for ejection from the upstream recording head 28 to record an image based on the image data received from the host computer 14 in a recording region 12*c* (region surrounded by the one-dot chain line in FIG. 7A) of the recording paper 12 (Step S15). Specifically, the control section 56 calculates the amounts of color inks to be ejected using the bitmap data (gradation value data) in which the recording dots (print dots) generated by the conversion through the image-processing section 58 are represented by gradation values and calculates the amount Q_color for each unit area on the basis of the sum of the calculation results. Thus, in this embodiment, the control section 56 also functions as an amount-used calculating unit. In addition, Step S15 corresponds to an amount-used calculating step. The amount Q_color is the total content of water in the total amount of color ink to be ejected from the upstream recording head 28 to record an image on the recording paper 12.

Subsequently, the control section 56 calculates the amount Q_clear of clear ink to be ejected onto the recordable region 12*a* to record an image in the recording region 12*c* of the recording paper 12 for each unit area (Step S16). Specifically, the control section 56 calculates the amount Q_clear of clear ink to be ejected so that the largest amount of clear ink lands at positions where no color inks ejected from the upstream recording head 28 land in the recordable region 12*a*. In addition, the control section 56 calculates the amount Q_clear of clear ink to be ejected so that, of the positions where the color inks ejected from the upstream recording head 28 land, a larger amount of clear ink lands at positions where a smaller amount of color ink ejected from the upstream recording head 28 lands in the recordable region 12*a* than at positions where a larger amount of color ink lands. Furthermore, the control section 56 calculates the amount Q_clear of clear ink to be ejected so that a smaller amount of clear ink lands at positions where a larger amount of color ink ejected from the upstream recording head 28 lands than at other positions. That is, the ejection pattern of the clear ink (supply pattern) is set in Step S16. Thus, the control section 56 also functions as a setting unit in this embodiment. In addition, Step S16 corresponds to a setting step.

Subsequently, the control section 56 outputs a control command for ejecting the inks from the upstream recording head 28 to the upstream-head driving section 64 (Step S17). The upstream-head driving section 64 then controls the upstream recording head 28 via the upstream head driver 53 to eject the magenta ink and the cyan ink onto the recording region 12*c* of the recording paper 12 and the clear ink onto the recordable region 12*a* of the recording paper 12. Thus, Step S17 corresponds to a first colored-liquid supplying step and an uncolored-liquid supplying step in this embodiment.

Subsequently, the control section 56 outputs a control command for ejecting the inks from the downstream recording head 29, to the downstream-head driving section 65 (Step S18). The downstream-head driving section 65 then controls the downstream recording head 29 via the downstream head driver 54 to eject the yellow ink and the black ink onto the recording region 12*c* of the recording paper 12. Thus, the control section 56, which outputs a control command to the head-driving sections 64 and 65, also functions as a control unit in this embodiment. In addition, Step S18 corresponds to another colored-liquid supplying step and a second colored-liquid supplying step. Steps S17 and S18 constitute a recording step. After the ink ejection from the recording heads 28 and 29 is completed, the control section 56 terminates the recording routine.

Figure 8:
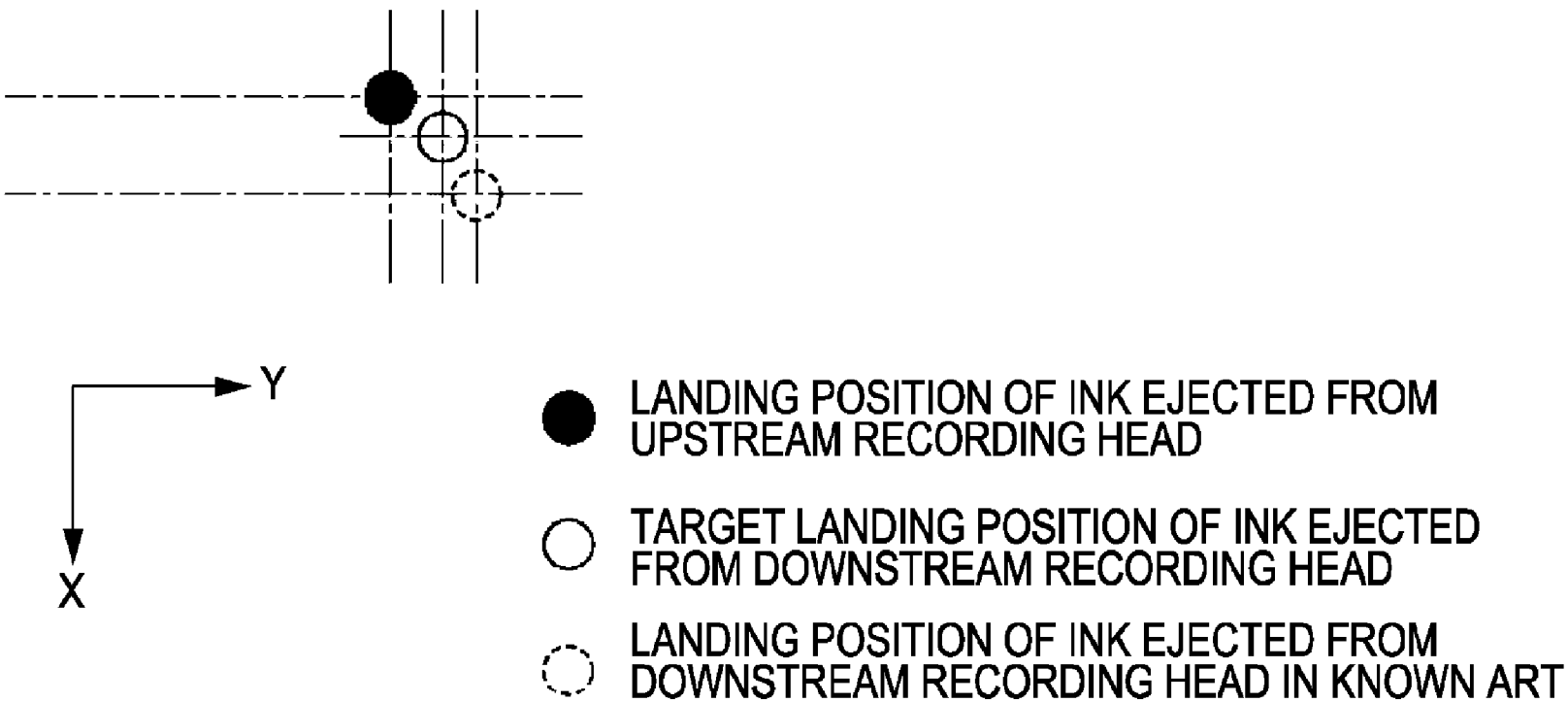
FIG. 8 is a diagram showing landing positions of ink ejected from recording heads.

If the correction in Step S14 above is not performed, as in the known art, the recording paper 12 expands or contracts after the ink ejection from the upstream recording head 28 and the heating with the heater 17 and causes the landing positions of the inks ejected from the downstream recording head 29 to deviate from the target positions, as shown in FIG. 8, depending on the degree of expansion or contraction of the recording paper 12. In this embodiment, therefore, recording paper 12 for the test procedure is used to measure the degree of expansion or contraction of the recording paper 12 (i.e., the amounts of misalignment Gx and Gy) due to the ink ejection from the upstream recording head 28 and the heating with the heater 17 before an image is recorded on the recording paper 12.

The downstream-head driving section 65 includes a nozzle-selecting circuit (not shown) that, if the amount of misalignment Gy is input, selects the nozzle orifices 30 from which the inks are to be ejected so that the amount of misalignment Gy is corrected (compensated for). The misalignment in the width direction Y is thus corrected by changing the nozzle orifices 30 selected by the nozzle-selecting circuit. At the same time, depending on the nozzle orifices 30 selected, a correction command is output to the timing-setting section 72 so that the second change time HT2 is corrected for the individual nozzle columns 32*a* to 32*e* including the nozzle orifices 30.

To correct the misalignment in the transportation direction X, additionally, the timing of ink ejection from the downstream recording head 29 is advanced for the inks landing on the downstream side with respect to the center of the recording paper 12 in the transportation direction X and is delayed for the inks landing on the upstream side with respect to the center of the recording paper 12 in the transportation direction X. As a result, the inks ejected from the downstream recording head 29 land at appropriate positions with respect to the landing positions of the inks ejected from the upstream recording head 28 onto the recording paper 12. This reliably eliminates the misalignment between the landing positions of the inks ejected from the upstream recording head 28 and the landing positions of the inks ejected from the downstream recording head 29.

Thus, this embodiment provides the following benefits.

(1) The pattern of ink ejection from the downstream recording head 29 is adjusted upon acquisition of the amounts of misalignment Gx and Gy between the landing positions of the inks ejected from the upstream recording head 28 onto the recording paper 12 and the landing positions at which the inks can be ejected from the downstream recording head (another recording unit) 29 onto the recording paper 12. As a result, the inks are ejected from the downstream recording head 29 onto the recording paper 12 such that the amounts of misalignment Gx and Gy are corrected. This allows the downstream recording head 29 to eject the inks toward the positions corresponding to the landing positions of the inks ejected from the upstream recording head 28 onto the recording paper 12 even if the recording paper 12 expands or contracts after absorbing the inks ejected from the upstream recording head 28. This embodiment therefore contributes to an improvement in the quality of an image recorded on the recording paper 12 even in the configuration in which the plurality of recording heads 28 and 29 that can eject the inks onto the recording paper 12 are arranged at intervals in the transportation direction X.

(2) In Step S12 above, the amount of ink equivalent to the total amount of ink (color inks and clear ink) used to actually record an image on the recording paper 12 (i.e., the predetermined amount Q_all) is ejected from the upstream recording head 28 onto the recording paper 12, and the amounts of misalignment Gx and Gy are acquired in that state. The pattern of ink ejection from the downstream recording head 29 is adjusted so as to correct the acquired amounts of misalignment Gx and Gy. Thus, the amounts of misalignment Gx and Gy are acquired with the recording paper 12 having absorbed an amount of water nearly equal to that absorbed by the recording paper 12 when an image is actually recorded. This allows the amounts of misalignment Gx and Gy to be acquired more accurately, thus contributing to an improvement in the quality of the image recorded on the recording paper 12.

(3) In Step S12 above, the reference marks Mb1 and Mb2 are formed on the recording paper 12 by the recording heads 28 and 29, respectively. The pattern of ink ejection from the downstream recording head 29 is then adjusted on the basis of the amounts of misalignment Gx and Gy between the reference marks Mb1 and Mb2. That is, the use of the reference marks Mb1 and Mb2, which are dedicated to the acquisition of the amounts of misalignment Gx and Gy, allows reliable acquisition of the amounts of misalignment Gx and Gy.

(4) In addition, the reference marks Mb1 and Mb2 are marks having straight-line portions extending in the transportation direction X and straight-line portions extending in the width direction Y. Therefore, a comparison between the positions of the first reference marks Mb1 formed by the upstream recording head 28 and the positions of the second reference marks Mb2 formed by the downstream recording head 29 allows more accurate acquisition of the amount of misalignment Gx in the transportation direction X and the amount of misalignment Gy in the width direction Y.

(5) The clear ink is ejected over the entire recordable region 12*a* of the recording paper 12 so that a smaller amount of clear ink lands at positions where a larger amount of color ink ejected from the upstream recording head 28 lands. Whatever the image to be recorded on the recording paper 12, therefore, the amount of ink (color inks and clear ink) ejected from the upstream recording head 28 remains nearly equal for recording paper 12 of comparable size and type. This allows the pattern of ink ejection from the downstream recording head 29 to be readily adjusted so as to correct the amounts of misalignment Gx and Gy.

(6) The color inks (yellow ink and black ink) are ejected from the downstream recording head 29 to positions identical in the transportation direction X to the positions where the clear ink has already been ejected from the upstream recording head 28 in the recording region 12*c* of the recording paper 12. That is, the amount of water absorbed (i.e., the total amount, excluding the colorant content, of ink ejected onto the recording paper 12) is nearly equal at any position in the transportation direction X where the color inks are supplied from the downstream recording head 29, and accordingly the degree of expansion or contraction is nearly equal at any position of the recording paper 12 in the transportation direction X. This avoids the need to adjust the pattern of ink ejection from the downstream recording head 29 for each position of the recording paper 12 in the transportation direction X, thus contributing to simpler adjustment of the pattern of ink ejection.

(7) The inks ejected from the upstream recording head 28 onto the recording paper 12 are volatized to some extent by the heater 17 before the ink ejection from the downstream recording head 29 is started. This prevents the inks ejected from the upstream recording head 28 onto the recording paper 12 from spreading before the inks are ejected from the downstream recording head 29 onto the recording paper 12, thus contributing to an improvement in the quality of the image recorded on the recording paper 12.

(8) In this embodiment, the test procedure in Step S12 is not executed upon reception of new image data unless the recording conditions are changed. This contributes to a reduction in the number of times the test procedure is executed as compared with the case where the test procedure is executed each time new image data is received. That is, the number of sheets of recording paper 12 used for the test procedure can be reduced.

The above embodiment may be changed to other embodiments as described below.

In the embodiment, the test procedure may be executed each time new image data is received. In this case, the ejection pattern of the clear ink for the test procedure or image recording is preferably set to such an ejection pattern that the content of water in each unit area of the recordable region 12*a* of the recording paper 12 is nearly equal to the content of water in the site where the largest amount of color ink ejected from the upstream recording head 28 to record an image lands. This contributes to a reduction in the amount of clear ink ejected for image recording.

In the embodiment, another heater 17 may be disposed downstream of the downstream recording head 29 in the transportation direction X. In addition, the heater 17 disposed between the recording heads 28 and 29 may be omitted.

In the embodiment, the clear ink does not have to be ejected onto the recording region 12*c* of the recording paper 12 because the color inks for recording an image have been ejected.

In the embodiment, the color inks may be ejected onto the recording region 12*c* of the recording paper 12 after the ejection of the clear ink onto the portion of the recordable region 12*a* other than the recording region 12*c* is completed.

In the embodiment, the downstream recording head 29 may be configured so that it does not eject the clear ink.

In the embodiment, the recording apparatus 13 may include three or more recording heads arranged in the transportation direction X. For example, a recording head for magenta ink, a recording head for cyan ink, a recording head for yellow ink, and a recording head for black ink may be sequentially arranged in the transportation direction X. In this case, the most upstream recording head and the most downstream recording head are preferably configured so that they can eject the clear ink. With this configuration, four colored-liquid supplying steps are executed.

In the embodiment, the clear ink does not necessarily have to be supplied to the recordable region 12*a* of the recording paper 12. In this case, it is desirable in Step S12 above to form the reference marks Mb1 and Mb2 at many positions of the recording paper 12 and to acquire the amounts of misalignment Gx and Gy for each position. In addition, it is desirable to adjust the pattern of ink ejection from the downstream recording head 29 for each position of the recording paper 12.

In this case, additionally, it is desirable in the test procedure to eject the amount of clear ink corresponding to the total amount of ink used for image recording (e.g., the total amount of ink used excluding the colorant content) onto the recording paper 12.

In the embodiment, in Step S15, the amount Q_color may be the total amount for each unit area of color ink (magenta and cyan inks) ejected from the upstream recording head 28 to record an image in the recording region 12*c* of the recording paper 12. In other words, the colorant content does not have to be taken into account.

Alternatively, the amount Q_color for each unit area may be the result obtained by multiplying the above total amount for each unit area by a predetermined value (e.g., 0.9). The amount Q_color for each unit area may also be determined from the calculated total amount for each unit area and a map or relational expression, prepared in advance, that represents the relationship between the total amount for each unit area and the amount Q_color for each unit area.

In the embodiment, the measurement positions Pk where the reference marks Mb1 and Mb2 are formed may be set in at least two positions of the recording paper 12. In this case, the measurement positions Pk are preferably set in the upper right and lower left in FIG. 7A.

In the embodiment, the reference marks Mb1 and Mb2 may have any shape (e.g., a circular or cross shape) that allows acquisition of the amount of misalignment Gx in the transportation direction X and the amount of misalignment Gy in the width direction Y.

In the embodiment, the scanner 18 may be disposed between the recording heads 28 and 29. In this case, an actual image formed by ink ejection from the upstream recording head 28 may be acquired as recording information by the scanner 18, and the amounts of misalignment Gx and Gy may be acquired from the results of comparison between the size of the actual image, which has been affected by expansion or contraction of the recording paper 12, and the desired image size. This avoids the need for the test procedure, thus suppressing an increase in the amount of recording paper 12 used. The desired image size refers to an image size based on the assumption that the recording paper 12 has not expanded or contracted after ink ejection from the upstream recording head 28.

The pattern of ink ejection from the downstream recording head 29 may be corrected by changing the direction of ink ejection from the nozzle orifices 30 depending on the amounts of misalignment Gx and Gy acquired.

The correction may also be executed by correcting the gradation values of the recording dots (print dots) depending on the amounts of misalignment Gx and Gy acquired. This provides the same effect as in the above embodiment.

Alternatively, the printer driver 40 of the host computer 14 may be used to execute correction equivalent to the correction of the gradation values described above.

In the embodiment, the pattern of ink ejection from the upstream recording head 28 may also be adjusted depending on the amounts of misalignment Gx and Gy acquired. If the pattern of ink ejection from the upstream recording head 28 is adjusted, the pattern of ink ejection from the downstream recording head 29 does not have to be corrected.

In the embodiment, a staggered arrangement of recording heads that are smaller than the recording heads 28 and 29 of the above embodiment may be used as a recording unit.

In addition, the recording heads 28 and 29 may be configured so that they are movable in the width direction Y. In this case, the recording heads 28 and 29 separately eject the inks while reciprocating in the width direction Y. It is desirable, however, to suspend the rotation of the transportation motor 24 during ink ejection from at least one of the recording heads 28 and 29.

In the embodiment, the recording units used may have any mechanism by which ink can be supplied to record an image on the recording paper 12 (e.g., a mechanism by which ink is applied to the recording paper 12).

In the embodiment, the uncolored liquid used may be any colorless liquid (e.g., water).

In the embodiment, instead of the recording paper 12, the recording medium used may be any other type of recording medium that expands or contracts by absorbing ink.

Although the ink-jet recording apparatus 13 is taken as an example of a recording apparatus in the embodiment, the type of recording apparatus used is not limited thereto; it may also be a recording apparatus that ejects or discharges a liquid other than ink (such as a liquid material in which particles of a functional material are dispersed or mixed or a fluid material such as gel). The term "liquid" used in this specification encompasses various types of materials such as inorganic solvents, organic solvents, solutions, liquid resins, liquid metals (metal melts), and other types of liquid materials and fluid materials.

What is claimed is:

1. A method for recording an image based on image data in a recording region of a recording medium being transported in a predetermined transportation direction, the method comprising:

forming a first reference mark in a recordable region, including the recording region of the recording medium, using a first colored liquid containing a water-soluble colorant and water;

supplying an uncolored liquid containing no colorant uniformly over the entire recordable region of the recording medium after the first reference mark is formed;

forming a second reference mark in the recordable region of the recording medium using a second colored liquid containing a water-soluble colorant and water;

detecting the amount of misalignment between the first reference mark and the second reference mark;

calculating the total amount of water to be used to record the image based on the image data on the recording medium for each unit area of the recording region of the recording medium;

calculating a difference between a predetermined amount of liquid and the calculated amount of water for each unit area as the amount of uncolored liquid to be supplied for each unit area;

supplying the calculated amount of uncolored liquid and the first colored liquid including the calculated amount of water onto the recording region of the recording medium; and supplying the second colored liquid to positions where at least one of the first colored liquid and the uncolored liquid has been supplied in the recording region of the recording medium such that the detected amount of misalignment is corrected.

* * * * *